US008432411B2

(12) United States Patent
Bell et al.

(10) Patent No.: US 8,432,411 B2
(45) Date of Patent: Apr. 30, 2013

(54) METHOD AND SYSTEM FOR IMPROVING DISPLAY QUALITY OF A MULTI-COMPONENT DISPLAY

(75) Inventors: Gareth Paul Bell, Auckland (NZ); Daniel E. Evanicky, San Jose, CA (US); Edward Maurice Granger, Novato, CA (US)

(73) Assignee: Pure Depth Limited, Auckland (NZ)

( * ) Notice: Subject to any disclaimer, the term of this patent is extended or adjusted under 35 U.S.C. 154(b) by 1333 days.

(21) Appl. No.: 11/804,650

(22) Filed: May 18, 2007

(65) Prior Publication Data

US 2008/0284792 A1 Nov. 20, 2008

(51) Int. Cl.
*G09G 5/02* (2006.01)

(52) U.S. Cl.
USPC ..... 345/589; 345/604; 345/5

(58) Field of Classification Search ..... 345/589, 345/604, 5
See application file for complete search history.

(56) References Cited

U.S. PATENT DOCUMENTS

| | | | |
|---|---|---|---|
| 3,863,246 | A | 1/1975 | Trcka et al. |
| 3,967,881 | A | 7/1976 | Moriyama et al. |
| 4,294,516 | A | 10/1981 | Brooks |
| 4,333,715 | A | 6/1982 | Brooks |
| 4,364,039 | A | 12/1982 | Penz |
| 4,371,870 | A | 2/1983 | Biferno |
| 4,472,737 | A | 9/1984 | Iwasaki |
| 4,485,376 | A | 11/1984 | Noble |
| 4,523,848 | A | 6/1985 | Gorman et al. |
| 4,568,928 | A | 2/1986 | Biferno |
| 4,649,425 | A | 3/1987 | Pund |
| 4,757,626 | A | 7/1988 | Weinreich |
| 4,768,300 | A | 9/1988 | Rutili |
| 4,815,742 | A | 3/1989 | Augustine |
| 5,050,965 | A | 9/1991 | Conner et al. |
| 5,075,993 | A | 12/1991 | Weinreich |
| 5,112,121 | A | 5/1992 | Chang et al. |
| 5,113,272 | A | 5/1992 | Reamey |
| 5,124,803 | A | 6/1992 | Troxel |
| 5,198,936 | A | 3/1993 | Stringfellow |
| 5,298,892 | A | 3/1994 | Shapiro et al. |

(Continued)

FOREIGN PATENT DOCUMENTS

| | | |
|---|---|---|
| AU | 82482/98 | 9/1998 |
| AU | 25542/99 | 9/1999 |

(Continued)

OTHER PUBLICATIONS

Office Action U.S. Appl. No. 10/519,285 Mail Date Feb. 2, 2009.

(Continued)

*Primary Examiner* — Maurice L McDowell, Jr.

(57) ABSTRACT

A method, computer-usable medium, and system for processing graphical data for display on a multi-component display is disclosed. Embodiments improve the display quality of multi-component displays by modifying graphical data to preemptively compensate for distortion caused by interstitial layers and/or display screens of the multi-component display, thereby enabling display of graphical objects from multi-component displays with improved optical characteristics. For example, where components of a multi-component display blur displayed images, graphical data used to display graphical objects may be modified to sharpen the graphical objects before display. The pre-sharpening amplifies the high frequency components of the displayed graphical objects to compensate for the dampening caused by passing the graphical objects through the components of the multi-component display.

27 Claims, 6 Drawing Sheets

U.S. PATENT DOCUMENTS

| | | | | |
|---|---|---|---|---|
| 5,300,942 | A | 4/1994 | Dolgoff | |
| 5,302,946 | A | 4/1994 | Shapiro et al. | |
| 5,361,165 | A | 11/1994 | Stringfellow et al. | |
| 5,367,801 | A | 11/1994 | Ahn | |
| 5,369,450 | A | 11/1994 | Haseltine et al. | |
| 5,473,344 | A | 12/1995 | Bacon et al. | |
| 5,515,484 | A | 5/1996 | Sfarti et al. | |
| 5,585,821 | A | 12/1996 | Ishikura et al. | |
| 5,675,755 | A | 10/1997 | Trueblood | |
| 5,694,532 | A | 12/1997 | Carey et al. | |
| 5,695,346 | A | 12/1997 | Sekiguchi et al. | |
| 5,745,197 | A | 4/1998 | Leung et al. | |
| 5,764,317 | A | 6/1998 | Sadovnik et al. | |
| 5,805,163 | A | 9/1998 | Bagnas | |
| 5,825,436 | A | 10/1998 | Knight | |
| 5,924,870 | A | 7/1999 | Brosh et al. | |
| 5,982,417 | A | 11/1999 | Blonde | |
| 5,990,990 | A | 11/1999 | Crabtree | |
| 5,999,191 | A | 12/1999 | Frank et al. | |
| 6,005,654 | A | 12/1999 | Kipfer et al. | |
| 6,054,969 | A | 4/2000 | Haisma | |
| 6,215,490 | B1 | 4/2001 | Kaply | |
| 6,215,538 | B1 | 4/2001 | Narutaki et al. | |
| 6,341,439 | B1 | 1/2002 | Lennerstad | |
| 6,356,281 | B1 | 3/2002 | Isenman | |
| 6,369,830 | B1 | 4/2002 | Brunner et al. | |
| 6,388,648 | B1 | 5/2002 | Clifton et al. | |
| 6,438,515 | B1 | 8/2002 | Crawford et al. | |
| 6,443,579 | B1 | 9/2002 | Myers | |
| 6,525,699 | B1 | 2/2003 | Suyama et al. | |
| 6,538,660 | B1 | 3/2003 | Celi, Jr. et al. | |
| 6,587,118 | B1 | 7/2003 | Yoneda | |
| 6,593,904 | B1 | 7/2003 | Marz et al. | |
| 6,609,799 | B1 | 8/2003 | Myers | |
| 6,661,425 | B1 | 12/2003 | Hiroaki | |
| 6,697,135 | B1 | 2/2004 | Baek et al. | |
| 6,717,728 | B2 * | 4/2004 | Putilin | 359/462 |
| 6,720,961 | B2 | 4/2004 | Tracy | |
| 6,845,578 | B1 | 1/2005 | Lucas | |
| 6,906,762 | B1 | 6/2005 | Witehira et al. | |
| 6,940,507 | B2 | 9/2005 | Repin et al. | |
| 6,958,748 | B1 | 10/2005 | Fukui et al. | |
| 7,113,188 | B2 | 9/2006 | Kuroda et al. | |
| 2002/0001055 | A1 | 1/2002 | Kimura et al. | |
| 2002/0093516 | A1 | 7/2002 | Brunner et al. | |
| 2002/0105516 | A1 | 8/2002 | Tracy | |
| 2002/0126115 | A1 * | 9/2002 | Ijntema | 345/214 |
| 2002/0126396 | A1 | 9/2002 | Dolgoff | |
| 2002/0163728 | A1 | 11/2002 | Myers | |
| 2002/0163729 | A1 | 11/2002 | Myers | |
| 2003/0090455 | A1 | 5/2003 | Daly | |
| 2003/0132895 | A1 | 7/2003 | Berstis | |
| 2003/0184665 | A1 | 10/2003 | Berstis | |
| 2004/0239582 | A1 | 12/2004 | Seymour | |
| 2005/0062897 | A1 * | 3/2005 | Lei | 348/806 |
| 2005/0146787 | A1 * | 7/2005 | Lukyanitsa | 359/462 |
| 2006/0227249 | A1 | 10/2006 | Chen et al. | |

FOREIGN PATENT DOCUMENTS

| | | |
|---|---|---|
| AU | 24806/00 | 7/2000 |
| AU | 24538/00 | 8/2000 |
| AU | 68219/01 | 12/2001 |
| CA | 2009960 | 9/1990 |
| CA | 2075807 | 8/1991 |
| CA | 2320694 | 8/1999 |
| CA | 2329702 | 9/1999 |
| CN | 1201157 | 12/1998 |
| CN | 1293805 | 5/2001 |
| CN | 1294695 | 5/2001 |
| DE | 2730785 | 1/1979 |
| DE | 29912074 | 11/1999 |
| DE | 19920789 | 5/2000 |
| EP | 0389123 | 9/1990 |
| EP | 454423 | 10/1991 |
| EP | 0460314 | 12/1991 |
| EP | 595387 | 5/1994 |
| EP | 0605945 | 7/1994 |
| EP | 0703563 | 3/1996 |
| EP | 0732669 | 9/1996 |
| EP | 0802684 | 10/1997 |
| EP | 872759 | 10/1998 |
| EP | 1057070 | 8/1999 |
| EP | 1058862 | 9/1999 |
| EP | 0999088 | 5/2000 |
| EP | 1151430 | 8/2000 |
| EP | 1177527 | 11/2000 |
| EP | 1093008 | 4/2001 |
| EP | 1287401 | 3/2003 |
| FR | 2609941 | 7/1988 |
| GB | 2312584 | 10/1997 |
| GB | 2347003 | 8/2000 |
| GB | 2372618 | 8/2002 |
| IL | 93472 | 11/1994 |
| JP | 61248083 | 11/1986 |
| JP | 63158587 | 7/1988 |
| JP | 3021902 | 1/1991 |
| JP | 3174580 | 7/1991 |
| JP | 3186894 | 8/1991 |
| JP | 3226095 | 10/1991 |
| JP | 3282586 | 12/1991 |
| JP | 4191755 | 7/1992 |
| JP | 4220691 | 8/1992 |
| JP | 4251219 | 9/1992 |
| JP | 5040449 | 2/1993 |
| JP | 6317488 | 11/1994 |
| JP | 8036375 | 2/1996 |
| JP | 8095741 | 4/1996 |
| JP | 09-033858 | 2/1997 |
| JP | 9146751 | 6/1997 |
| JP | 9244057 | 9/1997 |
| JP | 9282357 | 10/1997 |
| JP | 9308769 | 12/1997 |
| JP | 10003355 | 1/1998 |
| JP | 10039821 | 2/1998 |
| JP | 10105829 | 4/1998 |
| JP | 10228347 | 8/1998 |
| JP | 10-301508 | 11/1998 |
| JP | 10-334275 | 12/1998 |
| JP | 11205822 | 7/1999 |
| JP | 11272846 | 10/1999 |
| JP | 2000-142173 | 5/2000 |
| JP | 2000-347645 | 12/2000 |
| JP | 2001-100689 | 4/2001 |
| JP | 2000-99237 | 10/2001 |
| JP | 2001324608 | 11/2001 |
| JP | 2002504764 | 2/2002 |
| JP | 2001-215332 | 4/2002 |
| JP | 2002-131775 | 5/2002 |
| JP | 2001-56675 | 9/2002 |
| JP | 2002-271819 | 9/2002 |
| JP | 2002-350772 | 12/2002 |
| JP | 2002544544 | 12/2002 |
| JP | 2003507774 | 2/2003 |
| JP | 2002-099223 | 10/2003 |
| JP | 2003-316335 | 11/2003 |
| NO | 20005178 | 4/2001 |
| NZ | 505801 | 8/2002 |
| NZ | 505800 | 9/2002 |
| PL | 343229 | 4/2001 |
| WO | 88/05389 | 7/1988 |
| WO | 91/12554 | 8/1991 |
| WO | 98/47106 | 10/1998 |
| WO | 99/42889 | 8/1999 |
| WO | 9942889 | 8/1999 |
| WO | 99/44095 | 9/1999 |
| WO | 9945526 | 9/1999 |
| WO | 00/36578 | 6/2000 |
| WO | 00/48167 | 8/2000 |
| WO | 00/68887 | 11/2000 |
| WO | 01/01290 | 1/2001 |
| WO | 01/15127 | 3/2001 |
| WO | 01/15128 | 3/2001 |
| WO | 0157799 | 8/2001 |
| WO | 01/95019 | 12/2001 |
| WO | 02/35277 | 5/2002 |
| WO | 02/084637 | 10/2002 |

| | | |
|---|---|---|
| WO | 02/091033 | 11/2002 |
| WO | 03/003109 | 1/2003 |
| WO | 03032058 | 4/2003 |
| WO | 2004001488 | 1/2004 |
| WO | 2004102520 | 11/2004 |
| ZA | 9703025 | 11/1997 |

OTHER PUBLICATIONS

Office Action U.S. Appl. No. 10/519,285 Mail Date May 28, 2008.
Office Action U.S. Appl. No. 10/519,285 Mail Date Sep. 17, 2008.
Office Action U.S. Appl. No. 10/528,334 Mail Date Feb. 24, 2009.
Office Action U.S. Appl. No. 10/528,334 Mail Date Aug. 5, 2008.
Office Action U.S. Appl. No. 10/841,133 Mail Date Aug. 7, 2008.
Non Final OA Dated Feb. 2, 2009; U.S. Appl. No. 10/519,285.
Final OA Dated Feb. 24, 2009; U.S. Appl. No. 10/528,334.
Final Office Action Dated Aug. 17, 2009; U.S. Appl. No. 10/519,285.
Non-Final Office Action Dated Sep. 1, 2009; U.S. Appl. No. 10/528,334.
Non-Final Office Action Dated Sep. 9, 2009; U.S. Appl. No. 10/557,157.
Non-Final Office Action Dated Aug. 12, 2009; U.S. Appl. No. 12/107,589.
"Display", http://web.archive.org/web/20010717132509/http://whatis.techtarget.com/definition/0,,sid9__gci211965,00.html, Jul. 27, 2000.
Non-Final Office Action Dated Feb. 16, 2010; U.S. Appl. No. 12/107,589.
Non-Final Office Action Dated Jan. 11, 2010; U.S. Appl. No. 10/519,285.
Final Office Action Dated Apr. 15, 2010; U.S. Appl. No. 10/557,157.
Final Office Action Dated Jun. 25, 2010; U.S. Appl. No. 12/107,589.
Final Office Action Dated May 24, 2010; U.S. Appl. No. 10/519,285.
Notice of Allowance Dated Sep. 14, 2012; U.S. Appl. No. 12/089,390.
Non-Final Office Action Dated Mar. 26, 2012; U.S. Appl. No. 12/089,390.
Non-Final Office Action Dated Mar. 19, 2012; U.S. Appl. No. 10/519,285.
Notice of Allowance Dated Dec. 9, 2011; U.S. Appl. No. 10/557,157.
Notice of Allowance Dated Nov. 23, 2011; U.S. Appl. No. 10/528,334.
Final Office Action Dated Sep. 4, 2012; U.S. Appl. No. 12/778,039.
Non-Final Office Action Dated Jul. 30, 2012; U.S. Appl. No. 12/831,173.
Notice of Allowance Dated Jun. 27, 2012; U.S. Appl. No. 10/519,285.
Non-Final Office Action Dated Mar. 27, 2012; U.S. Appl. No. 12/778,039.
"Clearboard 1991-1994," http://web.media.mit.edu/~ishii/CB.html.
"Teamworkstation 1989-1994," http://web.media.mit.edu/~ishii/TWS.html.
"TEXTARC: An Alternate Way to View a Text," http://textarc.org, 2002.
"TEXTARC: NYSCA Grant and Public Installation," http//textarc.org, 2002.
"TEXTARC: The Print and the Artist," http://textarc.org, 2002.
Courter et al., Microsoft Office 2000 Professional Edition, 1999, Sybex Inc., pp. xxxi, 543, 685.
Harrison et al., "Transparent Layered User Interfaces: An Evaluation of a Display Design to Enhance Focused and Divided Attention" ACM, 13 pages, 1995.
Ishii et al., "Iterative Design of Seamless Collaboration Media", Communications of the ACM, Aug. 1994, vol. 37, pp. 83-97.
Office Action U.S. Appl. No. 10/489,101, Mar. 29, 2006.
Office Action U.S. Appl. No. 10/489,101, Jul. 16, 2007.
Office Action U.S. Appl. No. 10/489,101, Jul. 28, 2005.
Office Action U.S. Appl. No. 10/489,101, Nov. 22, 2005.
Office Action U.S. Appl. No. 10/519,285, Sep. 10, 2007.
Office Action U.S. Appl. No. 10/841,133, Jan. 8, 2007.
Office Action U.S. Appl. No. 10/841,133, Sep. 6, 2007.
Office Action U.S. Appl. No. 10/841,133, Nov. 28, 2007.

* cited by examiner

METHOD AND SYSTEM FOR IMPROVING DISPLAY QUALITY OF A MULTI-COMPONENT DISPLAY

BACKGROUND OF THE INVENTION

Multi-component displays generally include multiple display screens in a stacked arrangement. Each display screen can display images, thereby providing visual depth and other visual effects that a single display screen cannot. Additionally, diffusers, filters or other interstitial layers are often disposed between the display screens for altering characteristics of the multi-component display.

Diffusers are commonly used in multi-component displays to reduce the effect of banding or other repeated patterns, commonly known as Moiré interference. Moiré interference is introduced when display screens are stacked to form a multi-component display, and is typically caused by interference between color filters and the matrix of each display screen which covers the traces, leads and transistors allocated to each pixel. The distance between the rear display screen and the diffuser, as well as the scattering properties of the diffuser itself, can be varied to reduce Moiré interference.

Although diffusers are capable of reducing Moiré interference, they blur images displayed on a rear display screen of the multi-component display. Thus, steps can be taken to optimize the tradeoff between Moiré interference and blurriness by varying the scattering properties of the diffuser and/or varying the distance between the rear display screen and the diffuser. As a result, conventional multi-component displays blur images displayed on the rear display screen in an effort to reduce Moiré interference.

SUMMARY OF THE INVENTION

Accordingly, a need exists to reduce the blurriness of images displayed on multi-component displays. Additionally, a need exists to reduce image blur while also reducing Moiré interference associated with the multi-component display. Embodiments of the present invention provide novel solutions to these needs and others as described below.

Embodiments of the present invention are directed to a method, computer-usable medium, and system for processing graphical data for display on a multi-component display. More specifically, embodiments improve the display quality of multi-component displays by modifying graphical data to preemptively compensate for distortion caused by interstitial layers (e.g., a diffuser, filter, polarizer, lens, touchscreen, etc.) and/or display screens of the multi-component display, thereby enabling display of graphical objects from multi-component displays with improved optical characteristics (e.g., sharpness, tonal balance, color balance, etc.). For example, where components of a multi-component display blur displayed images (e.g., by dampening or reducing high frequency components of the displayed image), graphical data used to display graphical objects may be modified to sharpen the graphical objects before display. The pre-sharpening amplifies the high frequency components of the displayed graphical objects to compensate for the dampening caused by passing the graphical objects through the components of the multi-component display.

In one embodiment, a computer-controlled method of processing graphical data for display on a display device (e.g., a multi-component display) includes accessing the graphical data. Graphical alteration information associated with the display device is accessed, where the graphical alteration information is related to distortion of graphical objects displayed on the display device. The graphical data is processed in accordance with the graphical alteration information to generate updated graphical data, wherein the updated graphical data compensates for the distortion and is operable to improve the display quality of the display device. The processing may include amplifying high frequency components of the graphical data, which may include applying a low-pass filter to the graphical data to generate low-pass graphical data, subtracting the low-pass graphical data from the graphical data to generate high-pass graphical data, and adding the high-pass graphical data to the graphical data to generate the updated graphical data with amplified high frequency components. The method may also include transforming the graphical data from a first space (e.g., a RGB color space) to a second space (e.g., a luminance-chrominance space such as QTD, YUV, CIE LUV, CIE LAB, etc.), processing the graphical data in the second space to generate the updated graphical data in the second space, and transforming the updated graphical data from the second space to the first space.

In another embodiment, a computer-usable medium having computer-readable program code embodied therein may cause a computer system to perform a method of processing graphical data for improved display quality on a multi-component display. Additionally, in yet another embodiment, a system may include a processor coupled to a memory, wherein the memory includes instructions that when executed on the processor implement a method of processing graphical data for improved display quality on a multi-component display.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION OF THE INVENTION

Figure 1:
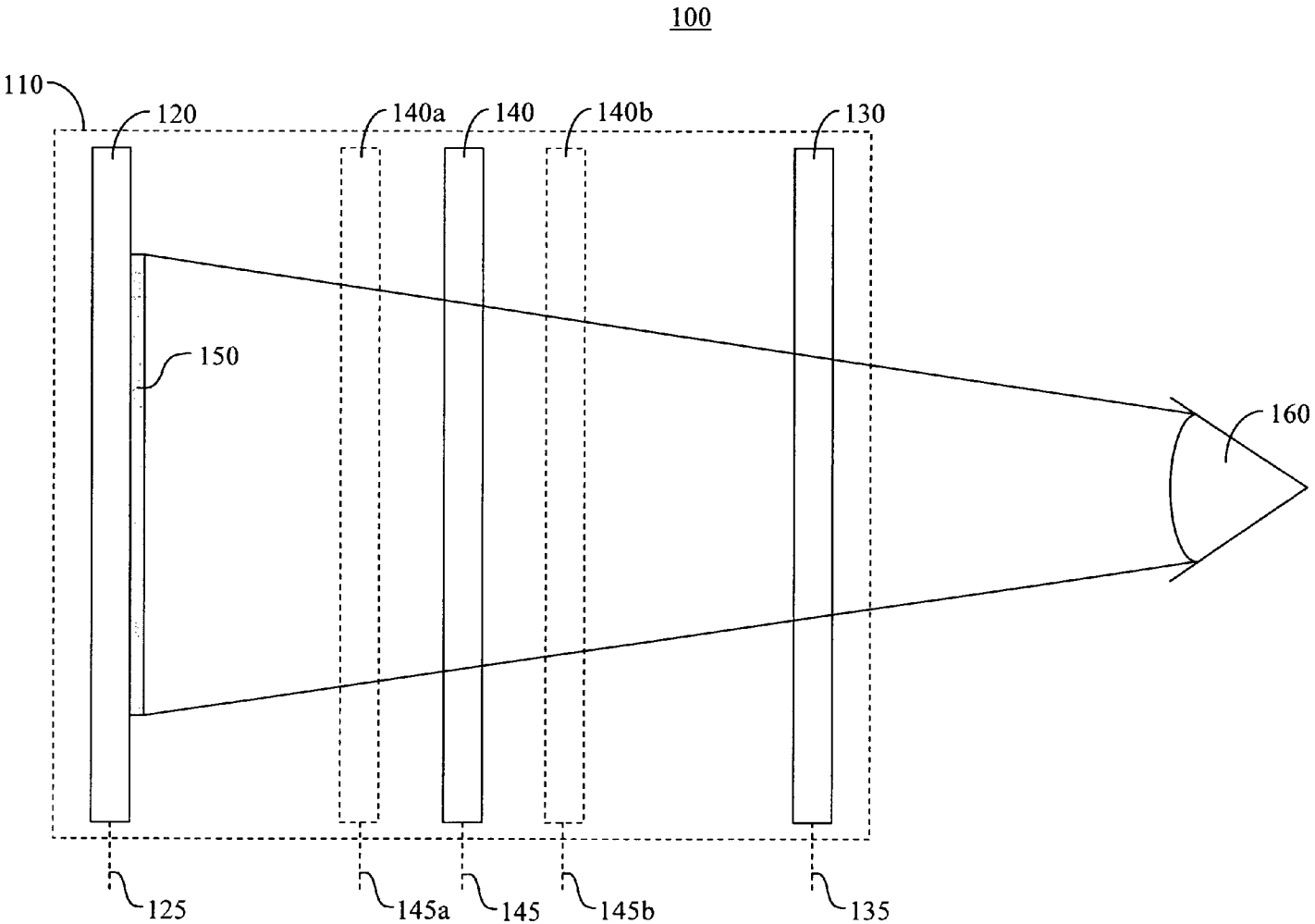
FIG. 1 shows a diagram of an exemplary display of graphical objects on an exemplary multi-component display in accordance with one embodiment of the present invention.

Reference will now be made in detail to embodiments of the present invention, examples of which are illustrated in the accompanying drawings. While the present invention will be discussed in conjunction with the following embodiments, it will be understood that they are not intended to limit the present invention to these embodiments alone. On the contrary, the present invention is intended to cover alternatives, modifications, and equivalents which may be included with the spirit and scope of the present invention as defined by the appended claims. Furthermore, in the following detailed description of the present invention, numerous specific details are set forth in order to provide a thorough understanding of the present invention. However, embodiments of the present invention may be practiced without these specific details. In other instances, well-known methods, procedures, components, and circuits have not been described in detail so as not to unnecessarily obscure aspects of the present invention.

Notation and Nomenclature

Some portions of the detailed descriptions which follow are presented in terms of procedures, logic blocks, processing and other symbolic representations of operations on data bits within a computer memory. These descriptions and representations are the means used by those skilled in the data processing arts to most effectively convey the substance of their work to others skilled in the art. In the present application, a procedure, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing the terms such as "accepting," "accessing," "adding," "analyzing," "applying," "assembling," "assigning," "calculating," "capturing," "combining," "comparing," "collecting," "creating," "defining," "depicting," "detecting," "determining," "displaying," "establishing," "executing," "generating," "grouping," "identifying," "initiating," "interacting," "modifying," "monitoring," "moving," "outputting," "performing," "placing," "presenting," "processing," "programming," "querying," "removing," "repeating," "sampling," "sorting," "storing," "subtracting," "transforming," "using," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

EMBODIMENTS OF THE INVENTION

FIG. 1 shows diagram 100 of an exemplary display of graphical objects on an exemplary multi-component display in accordance with one embodiment of the present invention. As shown in FIG. 1, multi-component display (MCD) 110 comprises rear display screen 120, front display screen 130 and optical component 140 disposed between display screens 120 and 130. Graphical objects 150 may be displayed on rear display screen 120 for viewing by observer 160, where observer 160 may comprise a human eye, an electrical and/or mechanical optical reception component (e.g., a still-image camera, moving-image camera, etc.), etc. It should be appreciated that optical component 140 and/or front display screen 130 may be semi-transparent and transmit sufficient light, in one embodiment, to enable viewing of graphical objects (e.g., 150) by observer 160.

Graphical objects 150 may comprise any visual display of rear display screen 120. In one embodiment, graphical objects 150 may comprise still images. The still images may comprise stand-alone images, or alternatively, frames of a video or other moving imagery. Alternatively, graphical objects 150 may comprise frame-less moving imagery. Additionally, graphical objects 150 may comprise multiple distinct images, contiguous portions of the same image, non-contiguous portions of the same image, etc.

As shown in FIG. 1, display screens 120 and/or 130 may comprise a liquid crystal display (LCD) matrix in one embodiment. Alternatively, display screens 120 and/or 130 may comprise organic light emitting diode (OLED) displays, transparent light emitting diode (TOLED) displays, cathode ray tube (CRT) displays, field emission displays (FEDs), field sequential display or projection displays. And in other embodiments, display screens 120 and/or 130 may comprise other display technologies.

Interstitial layers (e.g., optical component 140) may be disposed between display screens 120 and 130 for altering the display of graphical objects on the MCD (e.g., 110) and/or attributes of the MCD (e.g., 110) itself. For example, optical component 140 may comprise a filter (e.g., a spatial filter, etc.), a diffuser (e.g., holographic diffuser, optical component having a Gaussian profile, etc.), a polarizer, a lens, a touch-screen, or a combination thereof. Alternatively, optical component 140 may comprise a micro-optical structure. Thus, the type and/or characteristics of component 140 may be varied to change how graphical objects (e.g., 150) are displayed on MCD 110. For example, optical component 140 may affect Moiré interference, sharpness or blurriness, tonal balance, color balance, etc., associated with MCD 110 and/or the display of graphical objects (e.g., 150) on MCD 110.

In addition to or in place of varying attributes of optical component 140, the display of graphical objects on MCD 110 may also be adjusted by varying the position of optical component 140 with respect to rear display screen 120 and/or front display screen 130. As shown in FIG. 1, rear display screen 120 is located at position 125, front display screen is located at position 135, and optical component 140 is located at position 145. Optical component 140 may be shifted toward either rear display screen 120 (e.g., as indicated by optical component outline 140*a* at position 145*a*) or front display screen 130 (e.g., as indicated by optical component outline 140*b* at position 145*b*) to affect Moiré interference, sharpness or blurriness, tonal balance, color balance, etc., associated with MCD 110 and/or the display of graphical objects (e.g., 150) on MCD 110.

Embodiments of the present invention also enable MCD image display adjustment by processing graphical data prior to display on the MCD (e.g., 110). For example, distortion or image alteration caused by transmitting or viewing graphical objects through interstitial layers (e.g., 140) and/or display screens (e.g., 130) of the MCD (e.g., 110) may be compensated for prior to display. In one embodiment, the graphical data used to display the graphical objects (e.g., 150) may be modified (e.g., to account for distortion or image alteration of the MCD components) to generate updated graphical data. As such, the graphical objects (e.g., 150) generated from the updated graphical data may be displayed on MCD 110 (e.g., after passing through optical component 140 and front display screen 130) with improved optical characteristics (e.g., sharpness, tonal balance, color balance, etc.).

Accordingly, embodiments can be used to improve the display quality of MCDs, where those MCDs use optical components that introduce a tradeoff between two or more optical characteristics. For example, where optical component 140 comprises a diffuser, a tradeoff between Moiré interference associated with MCD 110 and sharpness of the display of graphical objects 150 is introduced. The attributes and/or positioning of component 140 may be varied to improve image quality with respect to at least one of the optical characteristics (e.g., reducing Moiré interference). Graphical data processing may then be performed to further improve the previously-adjusted optical characteristics and/or improve other optical characteristics (e.g., reduce blurriness, etc.). As such, embodiments enable the use of a wide variety of optical components (e.g., 140), where the display quality of the MCD (e.g., 110) may be improved regardless of the number, type, or attributes of the optical component or components used.

Although FIG. 1 shows optical component 140 disposed between the front and rear display screens (e.g., 120 and 130), it should be appreciated that optical component 140 may be alternatively positioned (e.g., disposed in front of front display screen 130) in other embodiments. Additionally, although FIG. 1 shows only one optical component (e.g., 140), it should be appreciated that MCD 110 may comprise more than one optical component in other embodiments, where each optical component may be placed in front of or behind display screen 120 and/or display screen 130. As such, graphical data processing may be performed to compensate for optical distortion or blur caused by optical components regardless of the position of the optical component (e.g., 140, etc.) with respect to display screens (e.g., 120, 130, etc.) of the MCD (e.g., 110).

Additionally, although FIG. 1 shows two display screens (e.g., 120 and 130), it should be appreciated that MCD 110 may comprise a larger or smaller number of display screens in other embodiments, where any additional display screens may be positioned behind, between or in front of (or any combination thereof the MCD components (e.g., display screen 120, display screen 130, optical component 140, etc.) depicted in FIG. 1. As such, in one embodiment, graphical data processing may be performed to compensate for optical distortion or blur caused by a touchscreen or other optical component positioned in front of a single-layer display screen. Further, it should be appreciated that the elements (e.g., 110-160) depicted in FIG. 1 are not drawn to scale, and thus, may comprise different shapes, sizes, etc. in other embodiments.

Figure 2:
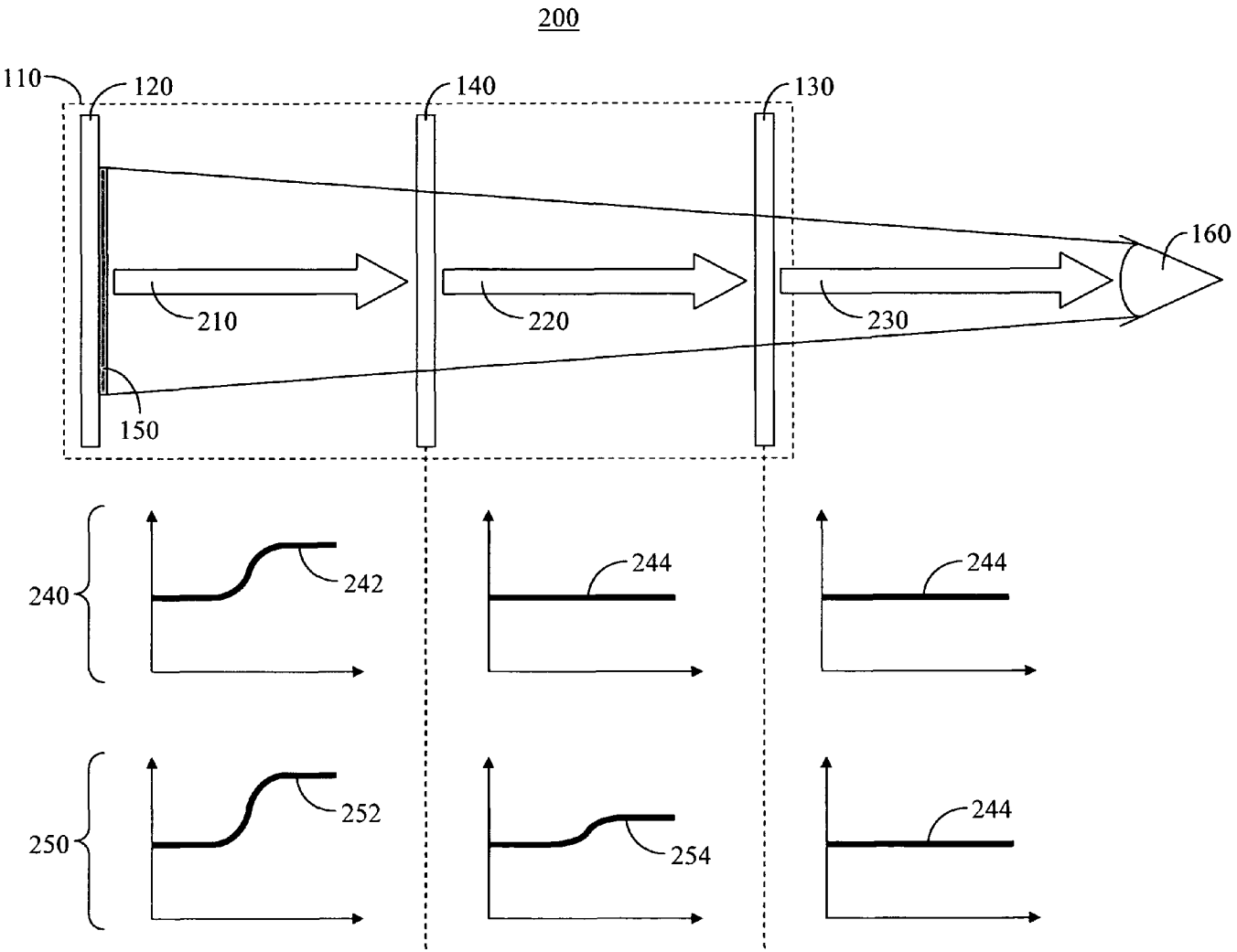
FIG. 2 shows a diagram of exemplary effects of multi-component display components on the frequency spectrum of displayed graphical objects in accordance with one embodiment of the present invention.

FIG. 2 shows diagram 200 of exemplary effects of multi-component display components on the frequency spectrum of displayed graphical objects in accordance with one embodiment of the present invention. As shown in FIG. 2, graphical objects 150 displayed by rear display screen 120 of MCD 110 travel along paths 210-230 to observer 160. More specifically, graphical objects 150 travel along path 210 from rear display screen 120 to optical component 140, along path 220 from optical component 140 to front display screen 130, then along path 230 from front display screen 130 to observer 160. Displayed graphical objects 150 have a respective spatial frequency spectrum in each path segment (e.g., 210-230) as represented by exemplary frequency spectrum groupings 240 and 250, where each grouping depicts different effects on the frequency spectrum given different characteristics of the MCD components (e.g., display screen 120, display screen 130 and optical component 140) in accordance with different embodiments of the present invention.

Frequency spectrum grouping 240 may represent an embodiment where an optical component (e.g., 140) dampens the high frequency components of the displayed graphical objects (e.g., 150), while the front display screen (e.g., 130) has little effect on the frequency spectrum. As depicted in FIG. 2, path 210 may have an associated frequency spectrum (e.g., 242) with amplified or amplified high frequency components to compensate for dampening or reduction of the high frequency components by optical component 140. The high frequency components may be amplified by processing the graphical data used to display graphical objects 150 as discussed above with respect to FIG. 1. As such, when passed through optical component 140, the amplified high frequency components are dampened (e.g., returning them to their pre-amplified levels) as indicated by substantially-flat frequency spectrum 244 associated with path 220. Since the front display screen (e.g., 130) has little effect on the frequency spectrum of the displayed graphical objects (e.g., 150) in this embodiment, frequency spectrum 244 is maintained upon passing the displayed graphical objects through front display screen 130. Therefore, path 230 may share an associated frequency spectrum (e.g., 244) with path 220.

Frequency spectrum grouping 250 may represent an optical component (e.g., 140) and front display screen (e.g., 130) which dampen the high frequency components of the displayed graphical objects (e.g., 150). As depicted in FIG. 2, path 210 may have an associated frequency spectrum (e.g., 252) with amplified or amplified high frequency components to compensate for dampening of the high frequency components by optical component 140 and front display screen 130. The high frequency components may be amplified by processing the graphical data used to display graphical objects 150 as discussed above with respect to FIG. 1. As such, when passed through optical component 140, the high frequency components are dampened as indicated by frequency spectrum 254 associated with path 220. Thereafter, the high frequency components are further dampened (e.g., returning them to their normal levels) when passed through front display screen 130 as indicated by substantially-flat frequency spectrum 254 associated with path 230.

In one embodiment, optical component 140 may comprise a diffuser (e.g., with a predetermined angular spread distribution, Gaussian profile, etc.) which blurs displayed graphical objects (e.g., 150) by dampening high frequency components of the displayed graphical objects (e.g., 150). Display screen 130 may also blur graphical objects (e.g., 150) by dampening high frequency components of the displayed graphical objects (e.g., 150) in one embodiment. As such, the graphical data used to display the graphical objects (e.g., 150) may be modified to sharpen the graphical objects (e.g., 150) before display. The pre-sharpening may amplify the high frequency components of the displayed graphical objects (e.g., 150) such that the blurring associated with optical component 140 and/or front display screen 130 may reduce the amplified high frequency components upon passing the graphical objects through the components (e.g., 140 and/or 130) of the MCD (e.g., 110). In one embodiment, the blurring of optical component 140 and/or front display screen 130 may return the amplified high frequency components to their pre-compensated or normal levels.

Although FIG. 2 attributes certain types of image distortion (e.g., shown by frequency spectrum groupings 240 and 250) to specific components (e.g., 130 and/or 140) of the MCD (e.g., 110), it should be appreciated that one or more of the MCD components (e.g., 130, 140, etc.) may alternatively distort (or produce no measurable distortion of) displayed graphical objects (e.g., 150) in other embodiments. Although FIG. 2 shows only one optical component (e.g., 140), it should be appreciated that MCD 110 may comprise more than one optical component in other embodiments. Additionally, although FIG. 2 shows only two display screens (e.g., 120 and 130), it should be appreciated that MCD 110 may comprise a larger or smaller number of display screens in other embodiments, where any additional display screens may be positioned behind, between or in front of (or any combination thereof) the MCD components (e.g., display screen 120, display screen 130, and optical component 140) depicted in FIG. 2. Further, it should be appreciated that the elements (e.g., 110-160) depicted in FIG. 2 are not drawn to scale, and thus, may comprise different shapes, sizes, etc. in other embodiments.

Figure 3:
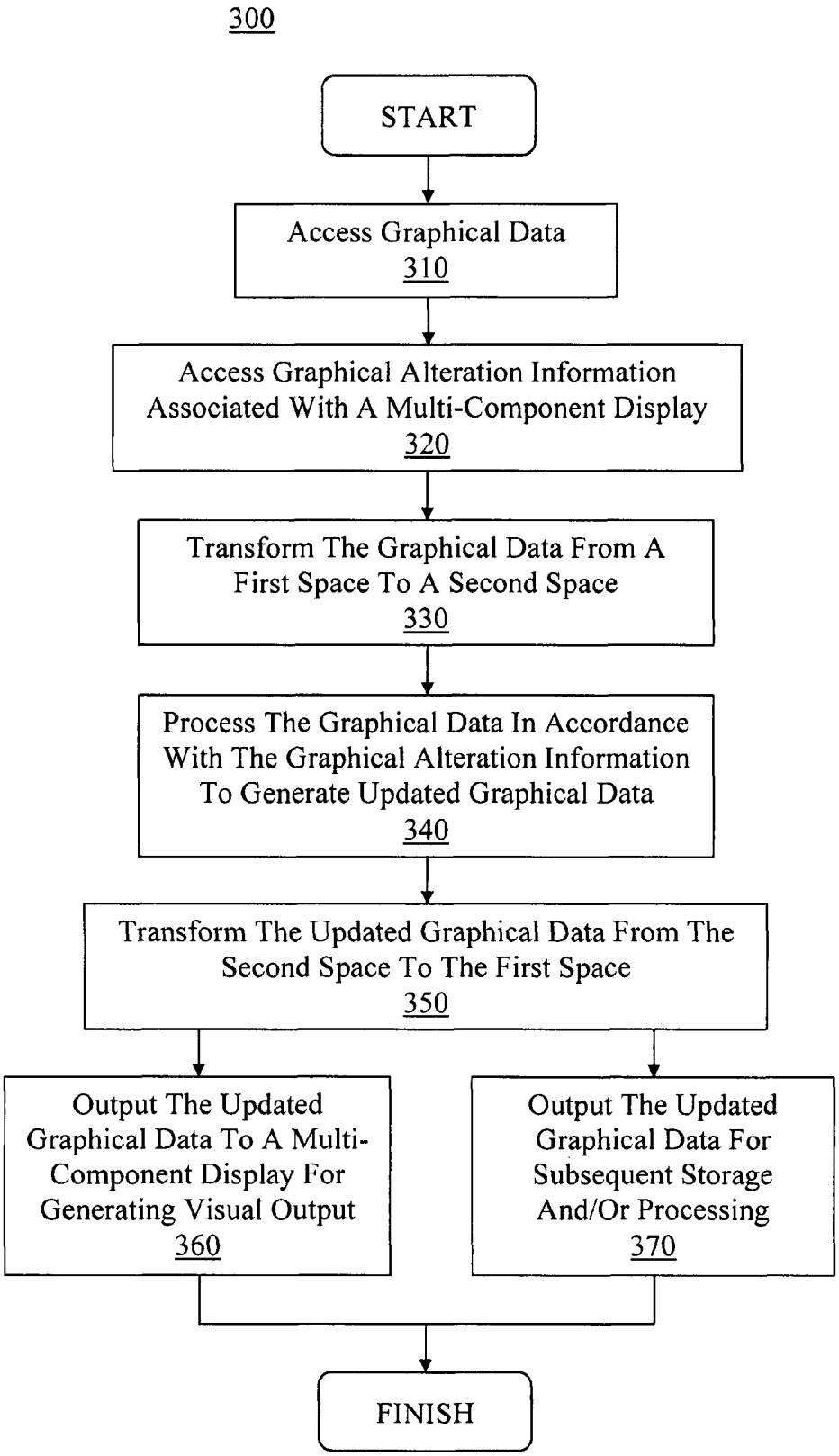
FIG. 3 shows an exemplary computer-implemented process for processing graphical data for improved display quality on a multi-component display in accordance with one embodiment of the present invention.
Figure 4:
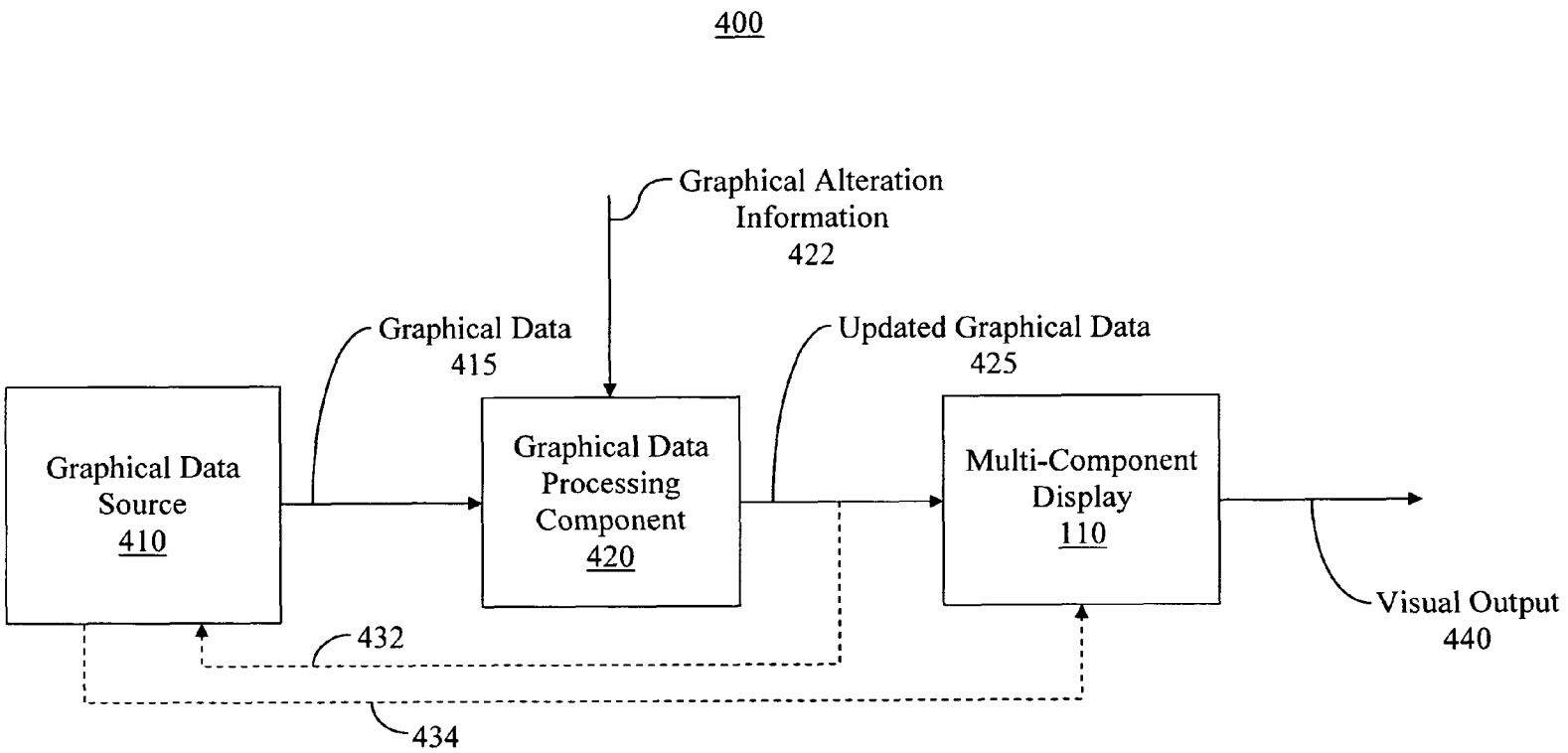
FIG. 4 shows an exemplary system for processing graphical data for improved display quality on a multi-component display in accordance with one embodiment of the present invention.

FIG. 3 shows exemplary computer-implemented process 300 for processing graphical data for improved display quality on a multi-component display in accordance with one embodiment of the present invention. FIG. 4 shows exemplary system 400 for processing graphical data for improved display quality on a multi-component display in accordance with one embodiment of the present invention. System 400 may be used to perform process 300 in one embodiment, and therefore, FIG. 4 will be described in conjunction with FIG. 3.

As shown in FIG. 3, step 310 involves accessing graphical data. The graphical data (e.g., 415) may be accessed from a graphical data source (e.g., 410) as shown in FIG. 4, where the graphical data source may comprise a memory (e.g., a frame buffer, main memory of a computer system, etc.), a processor (e.g., a graphics processing unit (GPU), central processing unit (CPU), etc.), other system/device (e.g., coupled to system 400, etc.), etc. The graphical data (e.g., 415) may be accessed by a graphical data processing component (e.g., 420) in one embodiment. Graphical data processing component 420 may be implemented by hardware (e.g., a graphics processing unit, an application-specific integrated circuit (ASIC) coupled to a graphics processing unit, etc.), software (e.g., graphics drivers, operating system code, etc.), or a combination thereof.

Step 320 involves accessing graphical alteration information associated with a MCD. The graphical alteration information (e.g., 422) may represent a distortion or image alteration associated with an optical component (e.g., 140) of an MCD (e.g., 110) produced when displayed graphical objects (e.g., 150) are passed or viewed (e.g., by observer 160) through the optical component (e.g., 140). Alternatively, the graphical alteration information (e.g., 422) may represent a distortion or image alteration associated with a display screen (e.g., 130, etc.) of an MCD (e.g., 110) produced when displayed graphical objects (e.g., 150) are passed or viewed (e.g., by observer 160) through the display screen (e.g., 130). And in other embodiments, the graphical alteration information (e.g., 422) may represent a distortion or image alteration associated with an optical component (e.g., 140) and a display screen (e.g., 130, etc.) of an MCD (e.g., 110) produced when displayed graphical objects (e.g., 150) are passed or viewed (e.g., by observer 160) through the optical component (e.g., 140) and the display screen (e.g., 130). Additionally, in one embodiment, graphical alteration information 422 may comprise a frequency response of an optical component (e.g., 140) and/or a display screen (e.g., 130, etc.) of an MCD (e.g., 110).

The graphical alteration information (e.g., 422) may be predetermined (e.g., stored in a memory of component 420, stored in a memory coupled to component 420, input by a user, etc.). Alternatively, the graphical alteration information (e.g., 422) may be dynamically determined (e.g., during operation) using an electrical and/or mechanical optical reception component (e.g., 160), where the graphical alteration information (e.g., 422) may be fed back (e.g., to component 420) for processing (e.g., thereby forming a control loop to control image distortion associated with MCD 110).

As shown in FIG. 3, step 330 involves transforming the graphical data (e.g., 415) from a first space to a second space (e.g., using component 420). The graphical data (e.g., 415) may be transformed from a current space to a space where processing to compensate for image distortion/alteration (e.g., caused by components of MCD 110) may be performed on a select number (e.g., fewer than all) of channels. In one embodiment, the graphical data (e.g., 415) may be transformed from a red-green-blue (RGB) color space to a luminance-chrominance space (e.g., QTD, YUV, CIE LUV, CIE LAB, etc.).

In one embodiment, a transformation of graphical data (e.g., 415) from a RGB color space to a QTD luminance-chrominance space may be performed in accordance with the following exemplary computer code:

```
X=[¼ ½ ¼;1−10;½ ½−1];

Q=X(1,1)*Image(:,:,1)+X(1,2)*Image(:,:,2)+X(1,3)
    *Image(:,:,3);

T=X(2,1)*Image(:,:,1)+X(2,2)*Image(:,:,2)+X(2,3)
    *Image(:,:,3);

D=X(3,1)*Image(:,:,1)+X(3,2)*Image(:,:,2)+X(3,3)
    *Image(:,:,3),
```

where "Image(:,:,1)" may represent the red channel of the graphical data (e.g., 415), "Image(:,:,2)" may represent the green channel of the graphical data (e.g., 415), and "Image (:,:,3)" may represent the blue channel of the graphical data (e.g., 415). As such, in one embodiment, the luminance channel Q may be calculated according to the equation $$Q=0.25*R+0.5*G+0.25*B,$$

where "R" represents the red channel of the graphical data (e.g., 415), "G" represents the green channel of the graphical data (e.g., 415), and "B" represents the blue channel of the graphical data (e.g., 415). Additionally, the two chrominance channels T and D may be calculated according to the following equations:

$$T=R-G,$$

$$D=0.5*R+0.5*G-B.$$

As shown in FIG. 3, step 340 involves processing the graphical data (e.g., 415) in accordance with the graphical alteration information (e.g., accessed in step 320) to generate updated graphical data (e.g., 425). The processing may be performed by a graphical data processing component (e.g., 420). Additionally, the updated graphical data (e.g., 425) may compensate for distortion or alteration of displayed graphical objects (e.g., 150) by components (e.g., 130, 140, etc.) of an MCD (e.g., 110) as represented by the graphical alteration information (e.g., 422). And in one embodiment, step 340 may be performed in accordance with process 500 of FIG. 5.

The processing of step 340 may be performed on a select number of channels of the graphical data (e.g., 415). For example, where the graphical data (e.g., 415) is transformed into a luminance-chrominance space (e.g., as discussed with respect to step 330 above), the luminance channel (e.g., the Q channel of a QTD luminance-chrominance space) may be processed alone in one embodiment. As such, processing efficiency may be increased by processing a single channel instead of multiple channels (e.g., if the graphical data were not transformed in step 330 and processing was performed on multiple color channels of the RGB color space). Processing efficiency may be further increased by decreasing the resolution (e.g., the bit-depth) of the luminance channel before processing in step 340. And in other embodiments, additional channels (e.g., the T channel, the D channel, etc.) may be processed for enhanced image distortion/alteration control, where the resolution of the additional channels may also be reduced for enhanced processing efficiency. Alternatively, the graphical data (e.g., 415) may be processed without transforming into a new space (e.g., thereby skipping step 330).

Step 350 involves transforming the updated graphical data (e.g., 425) from the second space (e.g., that transformed into in step 330) to the first space (e.g., the original space of graphical data 415 before any transformations in step 330). In one embodiment, a transformation of the updated graphical data (e.g., 425) from a QTD luminance-chrominance space to a RGB color space may be performed in accordance with the following exemplary computer code:

```
Y=inv([¼ ½ ¼;1−10;½ ½−1]);

R=Y(1,1)*tImage(:,:,1)+Y(2,1)*tImage(:,:,2)+Y(3,1)
    *tImage(:,:,3);

G=Y(1,2)*tImage(:,:,1)+Y(2,2)*tImage(:,:,2)+Y(3,2)
    *tImage(:,:,3);

B=Y(1,3)*tImage(:,:,1)+Y(2,3)*tImage(:,:,2)+Y(3,3)
    *tImage(:,:,3),
```

where Y may represent the inverse of the matrix (e.g., the X matrix) used for the RGB-to-QTD transformation in step 330, "tImage(:,:,1)" may represent the luminance channel Q of the updated graphical data (e.g., 425), "tImage(:,:,2)" may represent the first chrominance channel T of the updated graphical data (e.g., 425), and "tImage(:,:,3)" may represent the second chrominance channel D of the updated graphical data (e.g., 425).

As shown in FIG. 3, step 360 involves outputting (e.g., from component 420) the updated graphical data (e.g., 425) to an MCD for generating visual output. As shown in FIG. 4, MCD 110 may access the updated graphical data 425 and generate visual output 440 therefrom. As such, visual output 440 may correspond to path 230 of FIG. 2. Additionally, visual output 440 may be the result of displaying compensated graphical objects (e.g., 150) which are subsequently altered or distorted upon passing through components (e.g., 130, 140, etc.) of MCD 110. Thus, the image distortion/alteration of visual output 440 (e.g., caused by components of MCD 110) may be reduced to improve the display quality of MCD 110.

Alternatively, the updated graphical data (e.g., 425) may be output (e.g., from component 420) for subsequent storage and/or processing. In one embodiment, the updated graphical data (e.g., 425) may be returned to graphical data source 410 (e.g., for processing and/or storage) as indicated by arrow 432 in FIG. 4. Thereafter, the updated graphical data may be output to MCD 110 for subsequent display (e.g., in accordance with step 360) as indicated by arrow 434 in FIG. 4.

Figure 5:
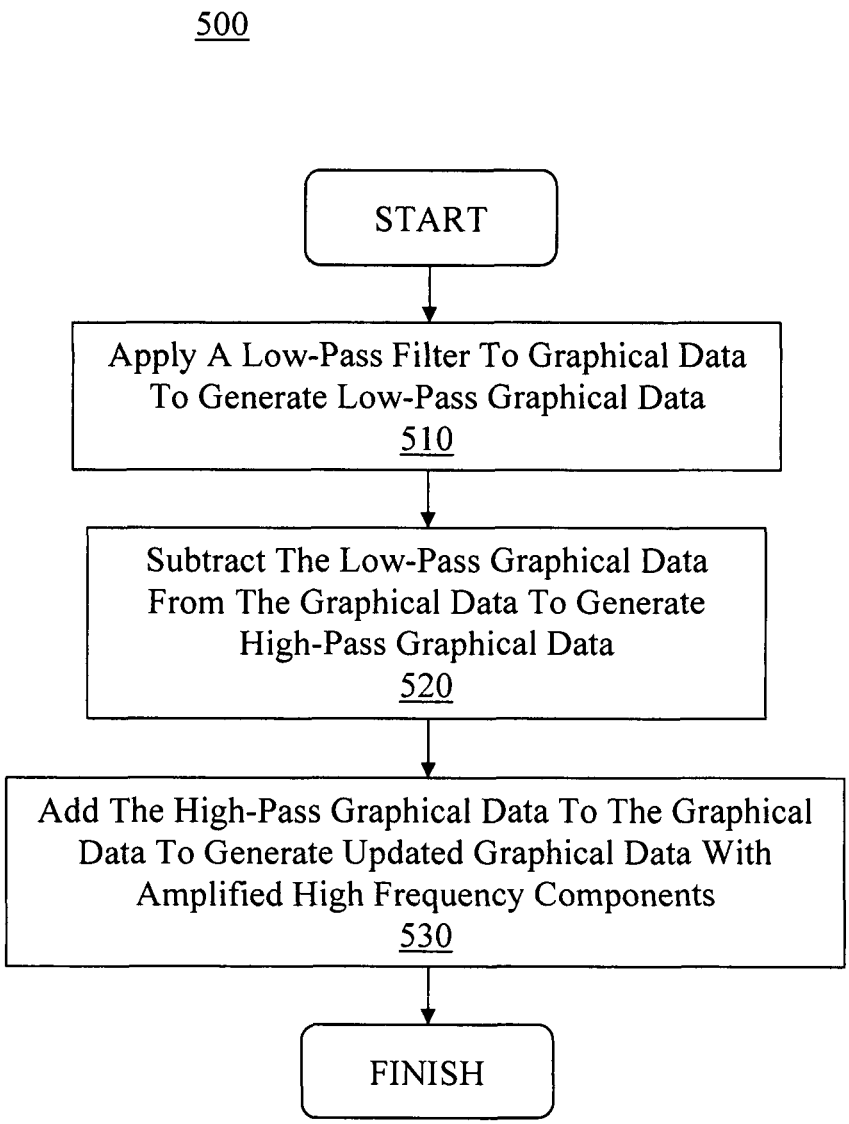
FIG. 5 shows an exemplary computer-implemented process for processing graphical data in accordance with graphical alteration information to generate updated graphical data in accordance with one embodiment of the present invention.

FIG. 5 shows exemplary computer-implemented process 500 for processing graphical data (e.g., 415) in accordance with graphical alteration information (e.g., 422) to generate updated graphical data (e.g., 425) in accordance with one embodiment of the present invention. The processing of process 500 may effectively sharpen graphical objects (e.g., 150) prior to display on an MCD (e.g., 110) in one embodiment, thereby compensating for blurring caused by passing the graphical objects (e.g., 150) through components (e.g., 130, 140, etc.) of the MCD (e.g., 110) to effectively improve display quality of the MCD (e.g., 110). In one embodiment, process 500 may be applied to sub-portions of the graphical data (e.g., row-by-row of pixels, multiple rows of pixels at a time, etc.). Alternatively, process 500 may be applied to larger portions of the graphical data (e.g., frame-by-frame, etc.).

As shown in FIG. 5, step 510 involves applying a low-pass filter to graphical data (e.g., 415, transformed graphical data produced by step 330 of process 300 of FIG. 3, etc.) to generate low-pass graphical data. The low-pass filter may attenuate or filter out substantially all of the high-frequency components of the graphical data and leave substantially all of the low-frequency components (e.g., comprising the low-pass graphical data). A variable cutoff frequency may be used to define the high frequencies to be filtered and the low frequencies to be left alone, where the cutoff frequency may be predetermined (e.g., stored in a memory, input by a user, etc.) or dynamically varied (e.g., in response to an image distortion/alteration measurement of an MCD).

In one embodiment, the graphical data may be low-pass filtered using the following exemplary computer code:

```
filter=fspecial('gaussian',filter_size,sigma);

transQ=conv(Q,filter);
```

where the fspecial function may implement a low-pass Gaussian filter (e.g., as indicated by the 'gaussian' argument) returning a matrix (e.g., named "filter") with a size defined by the argument "filter_size" and a standard deviation defined by the argument "sigma." The conv function may be used to apply the low-pass filter to a portion of the Q matrix (e.g., determined in step 330 of process 300 of FIG. 3), where the conv function returns the matrix "transQ" comprising low-pass graphical data. Alternatively, other channels of the QTD or other luminance-chrominance spaces may be low-pass filtered in step 510. And in other embodiments, channels of a color space (e.g., RGB) may be low-pass filtered in step 510.

Step 520 involves subtracting the low-pass graphical data (e.g., determined in step 510) from the graphical data (e.g., 415, transformed graphical data produced by step 330 of process 300 of FIG. 3, etc.) to generate high-pass graphical data. Thereafter, the high-pass graphical data (e.g., generated in step 520) may be added to the graphical data in step 530 to generate updated graphical data (e.g., 425) with amplified high-frequency components.

In one embodiment, steps 520 and 530 may be performed using the following exemplary computer code:

```
Qnew=Q+beta*(Q−alpha*transQ)
```

where alpha may represent a scaling factor applied to the low-frequency components (e.g., in the transQ matrix) subtracted from the graphical data (e.g., the Q matrix determined in step 330 of process 300 of FIG. 3) and beta may represent a scaling factor applied to the high-frequency components to be added to the graphical data (e.g., the Q matrix determined in step 330 of process 300 of FIG. 3). In one embodiment, alpha may range from approximately 0.5 to 1.5, while beta may range from approximately 0.25 to 1.25. As such, the matrix Qnew may represent the updated graphical data which is compensated (e.g., by amplifying the high-frequency components of the graphical data) to accommodate the distortion/alteration of MCD components (e.g., 130, 140, etc.), where Qnew may be formed by adding the Q matrix to the calculated high-frequency components (e.g., determined by subtracting the low-frequency components from the Q matrix). Alternatively, other channels of the QTD or other luminance-chrominance spaces may be processed in steps 520 and 530. And in other embodiments, channels of a color space (e.g., RGB) may be processed in steps 520 and 530.

Figure 6:
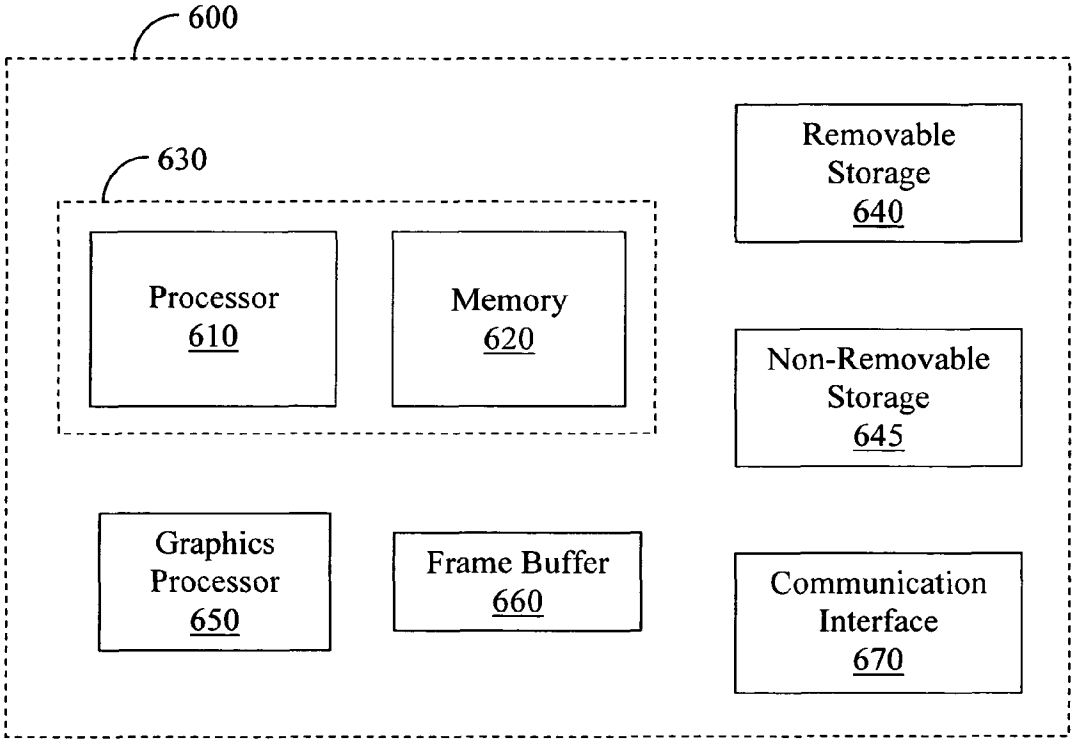
FIG. 6 shows an exemplary computer system platform upon which embodiments of the present invention may be implemented.

FIG. 6 shows exemplary computer system platform 600 upon which embodiments of the present invention may be implemented. As shown in FIG. 6, portions of the present invention are comprised of computer-readable and computer-executable instructions that reside, for example, in computer system platform 600 and which may be used as a part of a general purpose computer network (not shown). It is appreciated that computer system platform 600 of FIG. 6 is merely exemplary. As such, the present invention can operate within a number of different systems including, but not limited to, general-purpose computer systems, embedded computer systems, laptop computer systems, hand-held computer systems, portable computer systems, stand-alone computer systems, game consoles, gaming systems or machines (e.g., found in a casino or other gaming establishment), or online gaming systems.

In one embodiment, depicted by dashed lines 630, computer system platform 600 may comprise at least one processor 610 and at least one memory 620. Processor 610 may comprise a central processing unit (CPU) or other type of processor. Depending on the configuration and/or type of computer system environment, memory 620 may comprise volatile memory (e.g., RAM), non-volatile memory (e.g., ROM, flash memory, etc.), or some combination of the two. Additionally, memory 620 may be removable, non-removable, etc.

In other embodiments, computer system platform 600 may comprise additional storage (e.g., removable storage 640, non-removable storage 645, etc.). Removable storage 640 and/or non-removable storage 645 may comprise volatile memory, non-volatile memory, or any combination thereof. Additionally, removable storage 640 and/or non-removable storage 645 may comprise CD-ROM, digital versatile disks (DVD) or other optical storage, magnetic cassettes, magnetic tape, magnetic disk storage or other magnetic storage devices, or any other medium which can be used to store information for access by computer system platform 600.

As shown in FIG. 6, computer system platform 600 may communicate with other systems, components, or devices via communication interface 670. Communication interface 670 may embody computer readable instructions, data structures, program modules or other data in a modulated data signal (e.g., a carrier wave) or other transport mechanism. By way of example, and not limitation, communication interface 670 may couple to wired media (e.g., a wired network, direct-wired connection, etc.) and/or wireless media (e.g., a wireless network, a wireless connection utilizing acoustic, RF, infrared, or other wireless signaling, etc.).

Communication interface 670 may also couple computer system platform 600 to one or more input devices (e.g., a keyboard, mouse, pen, voice input device, touch input device, etc.) and/or output devices (e.g., a display, speaker, printer, etc.). In one embodiment, communication interface 670 may couple computer system platform 600 to a multi-component display (e.g., 110).

As shown in FIG. 6, graphics processor 650 may perform graphics processing operations on graphical data stored in frame buffer 660 or another memory (e.g., 620, 640, 645, etc.) of computer system platform 600. Graphical data stored in frame buffer 660 may be accessed, processed, and/or modified by components (e.g., graphics processor 650, processor 610, etc.) of computer system platform 600 and/or components of other systems/devices. Additionally, the graphical data may be accessed (e.g., by graphics processor 650) and displayed on an output device coupled to computer system platform 600. Accordingly, memory 620, removable storage 640, non-removable storage 645, frame buffer 660, or a combination thereof, may comprise instructions that when executed on a processor (e.g., 610, 650, etc.) implement a method of processing graphical data (e.g., stored in frame buffer 660) for improved display quality on a multi-component display (e.g., 110).

In the foregoing specification, embodiments of the invention have been described with reference to numerous specific details that may vary from implementation to implementation. Thus, the sole and exclusive indicator of what is, and is intended by the applicant to be, the invention is the set of claims that issue from this application, in the specific form in which such claims issue, including any subsequent correction. Hence, no limitation, element, property, feature, advantage, or attribute that is not expressly recited in a claim should limit the scope of such claim in any way. Accordingly, the specification and drawings are to be regarded in an illustrative rather than a restrictive sense.

What is claimed is:

1. A method of processing graphical data, said method comprising:

accessing said graphical data;

accessing graphical alteration information associated with a display device, wherein said display device comprises a display screen operable to display an image, wherein said display device further comprises at least one other component, wherein said display device and said at least one other component overlap, and wherein said graphical alteration information is associated with distortion of said image by said at least one other component; and processing said graphical data in accordance with said graphical alteration information to generate updated graphical data, wherein said updated graphical data compensates for said distortion and is operable to improve display quality of said display device.

2. The method of claim 1, wherein said processing comprises applying an image sharpening algorithm to said graphical data.

3. The method of claim 1, wherein said processing comprises amplifying high frequency components of said graphical data.

4. The method of claim 3, wherein said amplifying said high frequency components comprises:

applying a low-pass filter to said graphical data to generate low-pass graphical data;

subtracting said low-pass graphical data from said graphical data to generate high-pass graphical data; and adding said high-pass graphical data to said graphical data to generate said updated graphical data with amplified high frequency components.

5. The method of claim 1 further comprising:

transforming said graphical data from a first space to a second space;

processing said graphical data in said second space to generate said updated graphical data in said second space; and transforming said updated graphical data from said second space to said first space.

6. The method of claim 5, wherein said first space comprises a red-green-blue color space, and wherein said second space comprises a luminance-chrominance space.

7. The method of claim 1, wherein said at least one other component is an optical component.

8. The method of claim 7, wherein said optical component is selected from a group consisting of a filter, a diffuser, a polarizer, a lens, and a touchscreen.

9. The method of claim 1, wherein said at least one other component is at least one other display screen.

10. A non-transitory computer-usable medium having computer-readable program code embodied therein for causing a computer system to implement a method of processing graphical data, said method comprising:

accessing said graphical data;

accessing graphical alteration information associated with a display device, wherein said display device comprises a display screen operable to display an image, wherein said display device further comprises at least one other component, wherein said display device and said at least one other component overlap, and wherein said graphical alteration information is associated with distortion of said image by said at least one other component; and processing said graphical data in accordance with said graphical alteration information to generate updated graphical data, wherein said updated graphical data compensates for said distortion and is operable to improve display quality of said display device.

11. The computer-usable medium of claim 10, wherein said processing comprises applying an image sharpening algorithm to said graphical data.

12. The computer-usable medium of claim 10, wherein said processing comprises amplifying high frequency components of said graphical data.

13. The computer-usable medium of claim 12, wherein said amplifying said high frequency components comprises:

applying a low-pass filter to said graphical data to generate low-pass graphical data;

subtracting said low-pass graphical data from said graphical data to generate high-pass graphical data; and adding said high-pass graphical data to said graphical data to generate said updated graphical data with amplified high frequency components.

14. The computer-usable medium of claim 10 further comprising:

transforming said graphical data from a first space to a second space;

processing said graphical data in said second space to generate said updated graphical data in said second space; and transforming said updated graphical data from said second space to said first space.

15. The computer-usable medium of claim 14, wherein said first space comprises a red-green-blue color space, and wherein said second space comprises a luminance-chrominance space.

16. The computer-usable medium of claim 10, wherein said at least one other component is an optical component.

17. The computer-usable medium of claim 16, wherein said optical component is selected from a group consisting of a filter, a diffuser, a polarizer, a lens, and a touchscreen.

18. The computer-usable medium of claim 10, wherein said at least one other component is at least one other display screen.

19. A system comprising:

a processor;

a random access memory (RAM) coupled to said processor; and a non-transitory machine readable medium having a set of instructions embodied therein which are designed to be retrieved into said RAM and executed by said processor to implement a method of processing graphical data, said method comprising:

accessing said graphical data;

accessing graphical alteration information associated with a display device, wherein said display device comprises a display screen operable to display an image, wherein said display device further comprises at least one other component, wherein said display device and said at least one other component overlap, and wherein said graphical alteration information is associated with distortion of said image by said at least one other component; and processing said graphical data in accordance with said graphical alteration information to generate updated graphical data, wherein said updated graphical data compensates for said distortion and is operable to improve said display quality of said display device.

20. The system of claim 19, wherein in said method as implemented by said processor said processing comprises applying an image sharpening algorithm to said graphical data.

21. The system of claim 19, wherein in said method as implemented by said processor said processing comprises amplifying high frequency components of said graphical data.

22. The system of claim 21, wherein in said method as implemented by said processor said amplifying said high frequency components comprises:

applying a low-pass filter to said graphical data to generate low-pass graphical data;

subtracting said low-pass graphical data from said graphical data to generate high-pass graphical data; and adding said high-pass graphical data to said graphical data to generate said updated graphical data with amplified high frequency components.

23. The system of claim 19 wherein said program code further comprises instructions for execution by said processor to implement said method, said method further comprising:

transforming said graphical data from a first space to a second space;

processing said graphical data in said second space to generate said updated graphical data in said second space; and transforming said updated graphical data from said second space to said first space.

24. The system of claim 23, wherein in said method said first space comprises a red-green-blue color space, and wherein said second space comprises a luminance-chrominance space.

25. The system of claim 19, wherein in said method said at least one other component is an optical component.

26. The system of claim 25, wherein in said method said optical component is selected from a group consisting of a filter, a diffuser, a polarizer, a lens, and a touchscreen.

27. The system of claim 19, wherein in said method said at least one other component is at least one other display screen.

* * * * *